US007484336B2

(12) United States Patent
Stone

(10) Patent No.: US 7,484,336 B2
(45) Date of Patent: Feb. 3, 2009

(54) STABILIZER FOR IN-GROUND MEMBERS, ASSEMBLIES INCLUDING THE SAME, AND METHOD OF INSTALLATION

(75) Inventor: Ronald L. Stone, Plymouth, CT (US)

(73) Assignee: Ronald Stone, Plymouth, CT (US)

( * ) Notice: Subject to any disclaimer, the term of this patent is extended or adjusted under 35 U.S.C. 154(b) by 0 days.

(21) Appl. No.: 11/871,739

(22) Filed: Oct. 12, 2007

(65) Prior Publication Data

US 2008/0250730 A1 Oct. 16, 2008

Related U.S. Application Data

(63) Continuation of application No. 10/778,806, filed on Feb. 13, 2004, now abandoned.

(60) Provisional application No. 60/448,256, filed on Feb. 19, 2003.

(51) Int. Cl.
*E02D 5/74* (2006.01)
*E02D 5/80* (2006.01)

(52) U.S. Cl. ..... 52/156; 52/155; 52/165; 52/166; 405/244

(58) Field of Classification Search ..... 405/244, 405/232, 216, 233, 303; 52/168, 165, 154, 52/153, 166, 156; 248/523, 525, 507, 188.7, 248/530, 545; 108/50.12
See application file for complete search history.

(56) References Cited

U.S. PATENT DOCUMENTS 287,923 A * 11/1883 Goria ..... 52/154
459,583 A * 9/1891 Johnson ..... 248/340
676,968 A * 6/1901 Stanton ..... 119/789
1,359,704 A * 11/1920 Howell ..... 52/154
3,021,960 A * 2/1962 Pipe ..... 211/205
3,295,802 A * 1/1967 Leatherman ..... 248/523
3,861,097 A * 1/1975 Patterson et al. ..... 52/98
3,955,787 A * 5/1976 Brown ..... 248/159
4,052,827 A * 10/1977 Yancey ..... 52/156
4,269,010 A * 5/1981 Glass ..... 52/154
4,379,550 A * 4/1983 Petersen ..... 472/104
4,592,178 A * 6/1986 Lu ..... 52/155
4,753,411 A * 6/1988 Lechner et al. ..... 248/533
5,407,168 A * 4/1995 Shultz ..... 248/526
5,482,245 A * 1/1996 Graves ..... 248/523
5,622,015 A * 4/1997 Collins ..... 52/160

* cited by examiner

*Primary Examiner*—Phi Dieu Tran A
(74) *Attorney, Agent, or Firm*—Ronald Stone

(57) ABSTRACT

A stabilizer (10) for an in-ground member (12) includes: a mounting collar (16) having a channel (18) extending therethrough; a plurality of arms (20*a*-20*d*) having respective collar ends (30*a*-30*d*), the collar ends being adapted to extend through the channel and engage with the mounting collar; and a resilient member (40) being sized (a) to be disposed within the channel between the collar ends and (b) to be engaged by the in-ground member so as to urge the resilient member against the collar ends to force the collar ends against the mounting collar, whereby to rigidify the stabilizer. A method is disclosed for installing the above-described in-ground member into the ground to dispose a portion of it beneath the surface of the ground and to leave a portion of it extending above the surface of the ground. The method includes: inserting the collar ends (30*a*-30*d*) through the channel (18) of the mounting collar (16) so that the collar ends engage with the mounting collar; inserting a resilient member into the channel (18) so that the resilient member supports the collar ends, engaging the in-ground member with the resilient member; and driving the plurality of arms into the ground.

17 Claims, 3 Drawing Sheets

STABILIZER FOR IN-GROUND MEMBERS, ASSEMBLIES INCLUDING THE SAME, AND METHOD OF INSTALLATION

CROSS-REFERENCE TO RELATED APPLICATIONS

This application is a continuation of patent application Ser. No. 10/778,806, filed Feb. 13, 2004 now abandoned, and entitled "Stabilizer For In-Ground Members, Assemblies Including the Same, and Method of Installation", which claims the benefit of provisional patent application Ser. No. 60/448,256, filed on Feb. 19, 2003, which is incorporated herein in its entirety.

BACKGROUND OF THE INVENTION

1. Field of the Invention

The present invention concerns a stabilizer for in-ground members such as stakes, poles and the like. Typical of such in-ground members are the target stakes of horseshoes or ring-toss games, and poles used to support articles such as badminton or volleyball nets, flags or banners, tents, plants, vines and the like.

2. Related Art

The utilization of in-ground members such as target stakes in the games of horseshoes, ring-toss and the like, and support poles for any kind of article is, of course, well known in the art. A problem long encountered in the prior art is lack or loss of stability of such in-ground members, which usually are simply driven into the ground to provide their sole or primary means of support. As used herein, reference to "in-ground" members means and includes stakes, poles and the like, which are primarily or entirely supported by the ground into which they are driven. In this context, the phrase "the ground" means and includes earth, soil, sand, loam and the like, whether bare ground, plant-, grass- or lawn-covered ground, meadow, beach sand, clay, etc.

One difficulty with such in-ground members is a lack of stability, which may result from loosening of the ground retaining the member in place, which loosening may be aggravated by impacts sustained by, or stresses imposed on, the in-ground member. Such impacts may result from a game, such as when the target stake of a horseshoe game is impacted by the horseshoe striking it, and stresses may be imposed by the wind exerting a force on a tent, plant, flag or banner, or by physical contact by persons, animals or objects with the in-ground member or the article it supports.

SUMMARY OF THE INVENTION

The above discussed and other drawbacks and deficiencies are overcome or alleviated by a stabilizer for in-ground members that includes a mounting collar having a channel extending therethrough and a plurality of arms. Each of the plurality of arms has a collar end, which is adapted to extend through the channel and engage with the mounting collar. The stabilizer also includes a resilient member that has a bore and is sized to be disposed within the channel so as to support the collar end of each of the plurality of arms at the mounting collar. The resilient member is adapted to receive the in-ground member.

Additionally, a related method for installing an in-ground member into the ground to dispose a portion thereof beneath the surface of the ground and to leave a portion thereof extending above the surface of the ground, the method includes providing a plurality of arms that each have a collar end and a mounting collar and inserting the collar end through the channel of the mounting collar so that the collar end engages with the mounting collar. In addition, the method includes inserting a resilient member, which has a bore, into the channel of the mounting collar so that the resilient member supports the collar end and inserting an in-ground member into the bore so that the resilient member is forced against the mounting collar to provide rigidity to the plurality of arms. The method also includes driving the plurality of arms into the ground.

DETAILED DESCRIPTION OF THE INVENTION AND SPECIFIC EMBODIMENTS THEREOF

Figure 1:
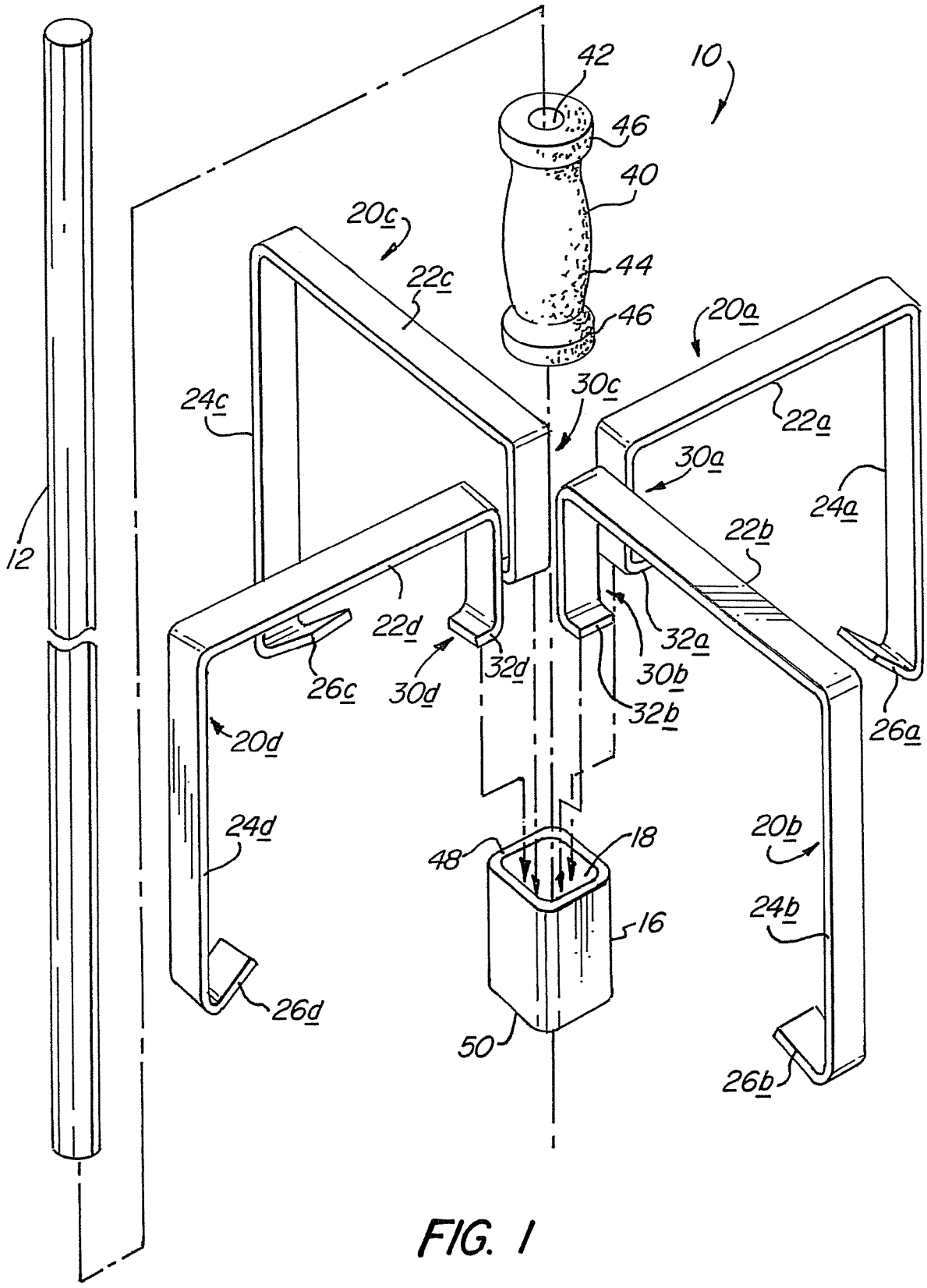
FIG. 1 is an exploded perspective view of a stabilizer in accordance with an embodiment of the present invention aligned with an in-ground member, a portion of which is embedded beneath the ground and another portion of which protrudes vertically above the ground.
Figure 2:
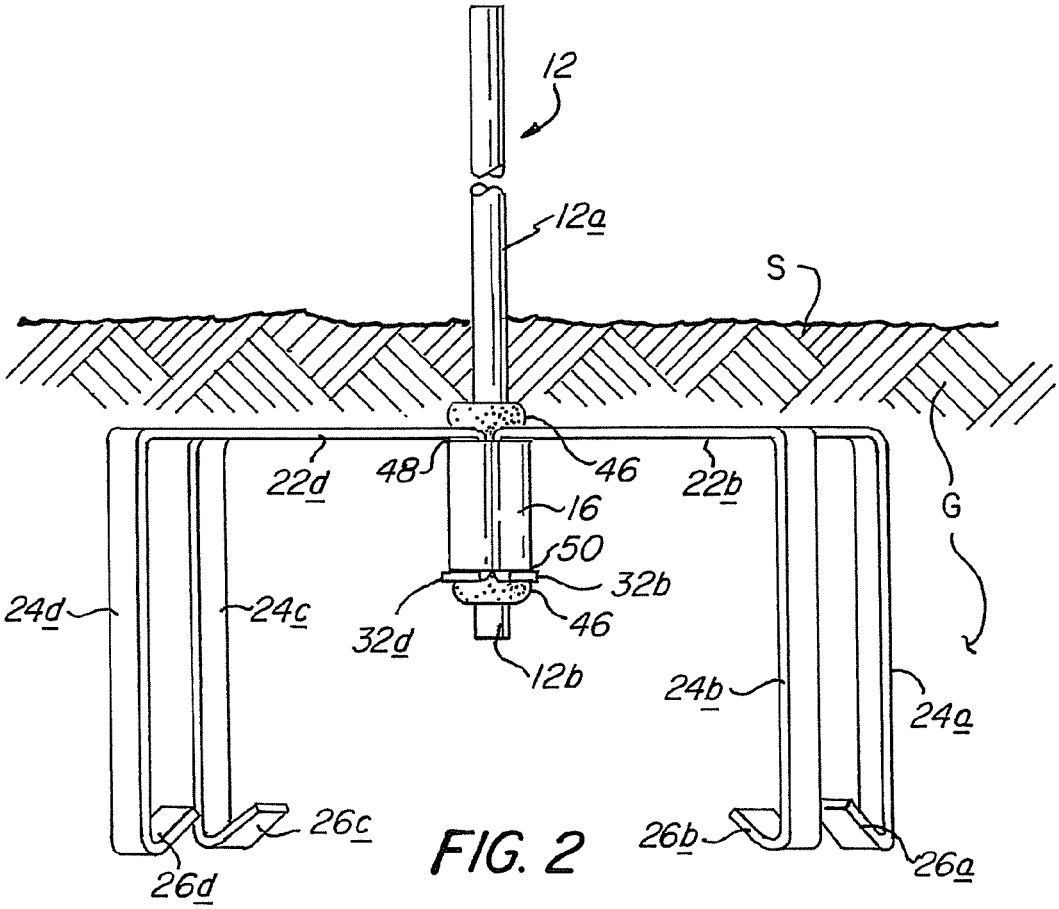
FIG. 2 is an elevation view, with the ground shown in cross section, showing an assembly of the stabilizer and in-ground member of FIG. 1 fully installed in the ground.
Figure 3:
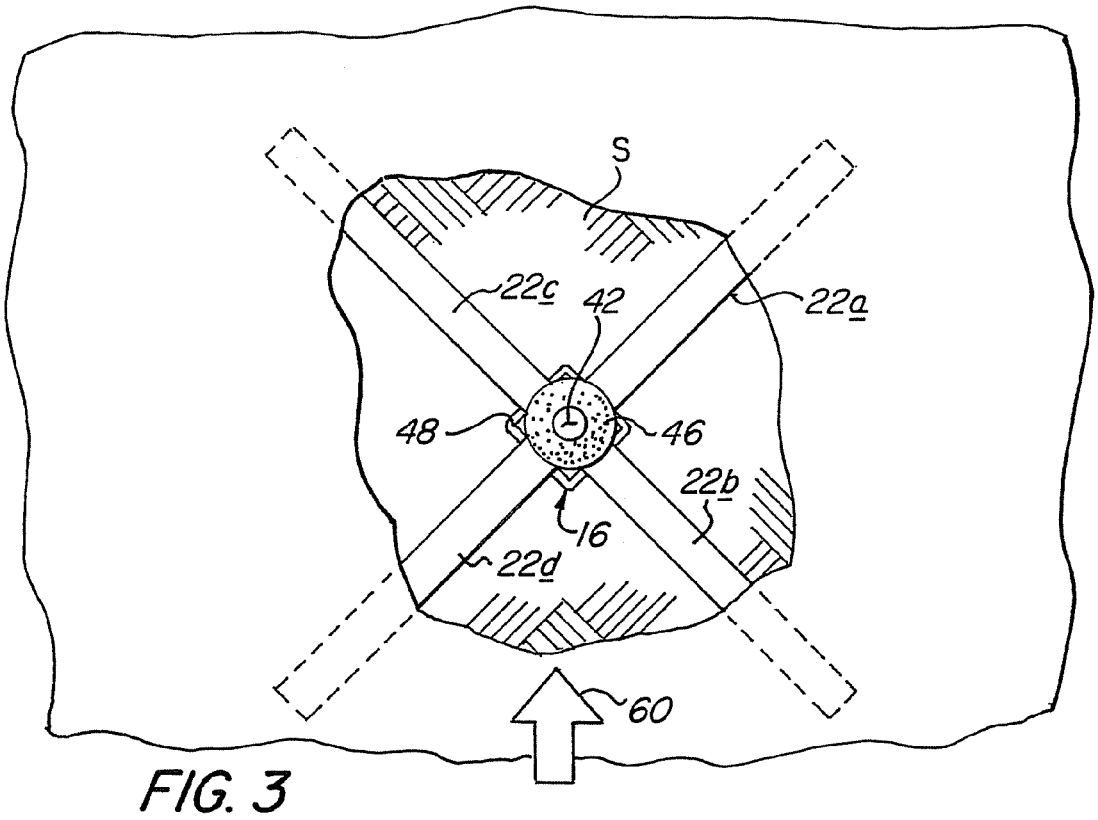
FIG. 3 is a plan view of an assembly of a fully installed stabilizer and in-ground member of FIG. 1.

Referring to FIGS. 1-3, there is shown a stabilizer 10 aligned with an in-ground member 12. In-ground member 12 has an above-ground portion 12*a* which extends vertically above the surface S of the ground G, and has a below-ground portion 12*b* which is embedded in the ground G.

Stabilizer 10 includes a mounting collar 16 that has a channel 18 extending therethrough. A plurality of arms is shown as four arms 20*a*, 20*b*, 20*c* and 20*d*. Arms 20*a*-20*d* are disposed at ninety-degree intervals about mounting collar 16, i.e., adjacent ones of the arms are at right angles to each other. Each arm 20*a*-20*d* includes a stabilizing section 22*a*, 22*b*, 22*c*, and 22*d* that extends radially from mounting collar 16, and an anchoring section 24*a*, 24*b*, 24*c*, and 24*d* that extends downwardly from stabilizing section 22*a*-22*d*. When stabilizer 10 is used for a horseshoe game, each stabilizing section 22*a*-22*d* may be in a range of approximately 8 inches to 10 inches and each anchoring section 24*a*-24*d* is at least 10 inches. In an exemplary embodiment, each stabilizing section 22*a*-22*d* is disposed approximately four inches below the ground.

The figures illustrate that stabilizing section 22*a*-22*d* and anchoring section 24*a*-24*d* are a continuous member with approximately a ninety-degree angle between the two sections. The advantage of this is ease of manufacturing and assembly. In addition, stabilizing section 22*a*-22*d* may also be a separate piece from anchoring section 24*a*-24*d* and the two sections may be coupled together by a bolt, screw, weld, or any other known means for attaching two sections.

Each anchoring section 24*a*-24*d* may also include a respective projection or foot 26*a*, 26*b*, 26*c*, and 26*d*, which helps to anchor the arms 20*a*-20*d* into the ground G. Each arm 20*a*-20*d* includes a respective collar end 30*a*-30*d* with a respective nub 32*a*-32*d*. Each collar end 30*a*-30*d* extends from stabilizing section 22*a*-22*d* in a downwardly direction through channel 18 so that nubs 32*a*-32*d* engage with mounting collar 16. Nubs 32*a*-32*d* help to keep the assembly from being forced upward upon impact. It will be appreciated that collar ends

30*a*-30*d* engage mounting collar 16 without the assistance of any mechanical means such as welds, bolts, screws, or the like.

Stabilizer 10 also includes a resilient member 40 that is inserted into channel 18 and helps to secure collar ends 30*a*-30*d* to mounting collar 16. Resilient member 40 also absorbs the impact when there is force placed on in-ground member 12, i.e., when a horseshoe ring impacts in-ground member 12, and also ensures that in-ground member 12 does not slip. Resilient member 40 may be made from foam, rubber, or any material that is compressible and resists compression. In addition, resilient member may also be a spring device or any type of device that is compressible and resists compression. Resilient member 40 includes a bore 42 that extends through member 40. Resilient member 40 is shaped so that it extends through mounting collar 16. In an exemplary embodiment, resilient member 40 has a curved body 44 and ears 46 (so that resilient member 40 is barbell shaped). Ears 46 expand over a top edge 48 and a bottom edge 50 of mounting collar and help to hold resilient member in place within mounting collar 16. Bore 42 is sized to be smaller than in-ground member 12 so that when in-ground member 12 is received into bore 42, resilient member 40 is compressed and securely holds in-ground member 12 at mounting channel 16.

Figure 4:
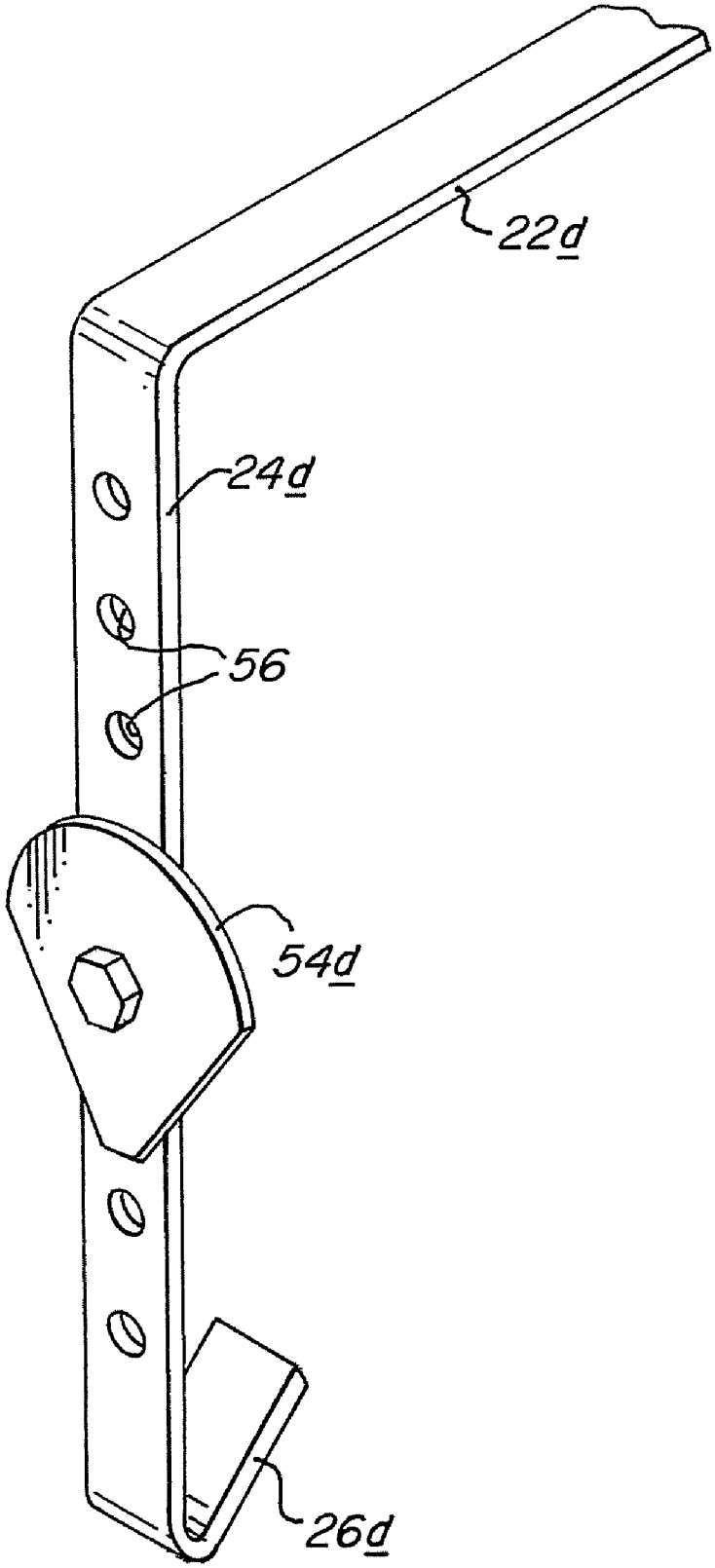
FIG. 4 is an elevation view of an alternative embodiment for an anchor leg of FIG. 1.

Referring to FIG. 4, an alternative embodiment of arms 20*a*-20*d* is illustrated. In addition, while only one arm is illustrated, it is understood that the embodiment is applicable to each of the arms 20*a*-20*d*. Anchoring section 24*d* may include an anchor fin 54*d*, which is attached to anchoring section 24*d*. In addition, anchoring section 24*d* may also include a plurality of holes 56 so that an installer may choose the height at which to attach anchor fin 54*d* to anchoring section 24*d*. By providing anchoring section 24*d* with a plurality of holes 56, anchor fin 54*d* may be positioned at various heights along anchoring section 24*d*. This enables variation of the depth of individual anchor fins below ground surface when the installation is complete, and/or permits fastening of more than one anchor fin to a given anchoring section. Each anchor fin 54*a*, 54*b*, 54*c* (not shown), and 54*d* may be arranged at similar heights or at least one anchor fin may be offset for one of the other anchor fins. In an exemplary embodiment, anchor fin 54*d* is somewhat fan-shaped. Anchor fin 54*d* may be attached to anchoring section 24*d* by a mechanical fastener, such as a bolt, screw, weld, or the fins may ride in a track (not shown) on the anchoring section, and may be locked in place at a desired position by a detent or other suitable locking member.

Referring again to FIG. 3, an exemplary embodiment for arranging stabilizer 10 in ground G is illustrated. If stabilizer 10 is used for a horseshoe game, there is enhanced stability by arranging stabilizer 10 in an X formation so that a horseshoe is thrown at in-ground member 12 from a direction 60. Direction 60 shows the impact force that would be imposed on in-ground member 12 if it served as the target stake of a horseshoes game in which the horseshoes were pitched from a position that causes them to travel along a path substantially parallel to, and in the direction 60.

Referring to FIGS. 1-3, in order to attain the assembly of stabilizer 10 and in-ground member 12, the following method is utilized. A hole for the mounting collar 16 and four trenches, for each stabilizing section 22*a*-22*d* of each arm 20*a*-20*d*. Stabilizer 10 is then assembled by sliding each collar end 30*a*-30*d* through channel 18 so that nubs 32*a*-32*d* hook onto bottom edge 50. Resilient member 40 is then inserted into channel 18 and in-ground member 12 is slid into bore 42. Anchoring sections 24*a*-24*d* are then placed on the ground G with foot 26*a*-26*d* each being located in one of the trenches and with mounting collar 16 located directly above the hole. Anchoring sections 24*a*-24*d* are then driven into the ground by either pushing on arms 20*a*-20*d* or using a sledgehammer to drive anchoring sections 24*a*-24*d* into the ground G. Repeated blows distributed in sequence to each arm 20*a*-20*d* will drive stabilizer 10 into the ground to the position illustrated in FIG. 2. If the ground G comprises a loose soil or sand, for example, beach sand or a sand or loam used in a game such as horseshoes or ring-toss, stabilizer 10 will, of course, be easily driven into the ground G and holes and trenches may not be necessary. Once stabilizing sections 22*a*-22*d* are located within the trenches and mounting collar 16 is located in the hole, the hole and trenches are backfilled so as to cover stabilizer 10 and to have a section of in-ground member 12 extending above ground G.

It will be appreciated that stabilizer 10 will provide an extremely secure retention of in-ground member 12 within ground G, and will provide a high degree of resistance to impacts in any direction, but especially in the direction of the arrow 60 of FIG. 3, thereby maintaining in-ground member 12 and its above-ground portion in desired alignment, usually vertical, relative to the surface S of ground G.

While four arms 20*a*-20*d* have been illustrated as extending radially outwardly from mounting collar 16 at ninety-degree intervals, more or fewer than four arms may be used and they may be positioned at equal or unequal radial intervals, depending on the nature of the ground and whether directionality of highest resistance to impact is desired.

It will be appreciated that the in-ground member of the invention need not be a target stake for horseshoes or ring-toss as illustrated, but may be a tent pole, fence post, some other type of post, a pole or other in-ground member, or the like. Such in-ground members, alone or in cooperation with similar or identical in-ground members, may serve to support any of a wide range of articles, for example, a badminton or volleyball net or the like, a flag or banner, a tent, growing plants and vines, etc. Whatever the purpose of the in-ground member, a stabilizer in accordance with the present invention, such as stabilizer 10, will enormously enhance the stability of any type of in-ground member.

The advantages of stabilizer 10 are that stabilizer 10 is inexpensive to make and it can be shipped disassembled. Stabilizer 10 is also easy to assemble and may be assembled in the field at the time of installation into the ground.

While the invention has been described with respect to specific preferred embodiments thereof, it will be appreciated that numerous variations may be made to these specific embodiments which variations nonetheless lie within the spirit and scope of the present invention. For example, the stabilizer may be made of any suitable material, metal, plastic or a combination thereof, and it may be formed of components which are secured to each other by any suitable means, or it may be an integrally-formed, i.e., one-piece, stabilizer. The stabilizer of the present invention may be dimensioned and configured to be fitted onto an existing in-ground member, or it may be pre-assembled with an in-ground member to provide a unitary assembly comprising a stabilizable in-ground member.

What is claimed is:

1. In combination, a stabilizer for an in-ground member and the in-ground member, the combination comprising:

a mounting collar having a bottom edge and a channel extending through the mounting collar;

a plurality of arms having respective collar ends, said collar ends being configured to extend through said channel and to terminate in respective nubs that hook onto the bottom edge of said mounting collar, said plurality of arms further including respective stabilizing sections and anchoring sections, said stabilizing sections being disposed adjacent to said collar ends and extending radially from said mounting collar for a first distance to a first end, said anchoring sections extending from said first end downwardly for a second distance to a distal end; and a resilient member being configured (a) to be disposed within said channel between said collar ends and (b) to be engaged by the in-ground member so as to urge said resilient member against said collar ends to force said collar ends against said mounting collar, whereby to rigidify said stabilizer;

the in-ground member comprising an above-ground portion and a below-ground portion and being configured so that, when the stabilizer is installed in the ground, the above-ground portion extends vertically above the surface of the ground and the below-ground portion is embedded within the ground.

2. The combination of claim 1 wherein said respective nubs protrude beyond the bottom edge of said mounting collar.

3. The combination of claim 1 wherein said resilient member has at least one ear that overlaps an edge of said mounting collar.

4. The combination of claim 1 wherein said anchoring sections include respective projections disposed at said distal end.

5. The combination of claim 1 wherein an angle between one of said stabilizing sections and one of said anchoring sections is approximately 90 degrees.

6. The combination of claim 1 wherein at least one of said stabilizing sections and at least one of said anchoring sections are coupled together at said end.

7. The combination of claim 1 wherein at least one of said anchoring sections includes at least one hole for mounting an anchor fin.

8. The combination of claim 1 wherein at least one of said anchoring sections includes an anchor fin, said anchor fin being adjustable.

9. The combination of claim 1 wherein each of said anchoring sections includes an anchor fin and one of said anchor fins is disposed at a higher elevation than the other anchor fins.

10. The combination of claim 1 wherein said resilient member has a bore therein, which bore is configured so that upon insertion of the in-ground member into said bore, said resilient member is forced by such in-ground member against said collar ends to force said collar ends against said mounting collar to provide rigidity to said stabilizer.

11. The combination of claim 1 wherein at least the above-ground portion of the in-ground member is configured as a vertical post.

12. The combination of claim 11 wherein the plurality of arms comprises two arms which intersect at their respective midpoints to define in plan view an X formation installed in the ground in an orientation such that a hypothetical straight line (a) connecting a singular given location remote from the combination to (b) the in-ground member retained within the combination, is perpendicular to a hypothetical straight line drawn between adjacent outermost tips of the two arms facing towards the singular location.

13. The combination of claim 1 wherein the arms are integral members and the first end comprises a bend of approximately 90 degrees.

14. A method for installing an in-ground member into the ground to dispose a portion thereof beneath the surface of the ground and to leave a portion thereof extending above the surface of the ground, the method comprising:

providing a mounting collar having a bottom edge and a channel extending through said mounting collar;

providing a plurality of arms having respective stabilizing sections and anchoring sections, said stabilizing sections terminating in respective nubs, the stabilizing sections being disposed adjacent to said collar ends and extending radially from said mounting collar for a first distance to a first end, said anchoring sections extending from said first end downwardly for a second distance to a distal end;

inserting said collar ends through said channel of said mounting collar so that said collar ends engage with said mounting collar;

inserting a resilient member into said channel of said mounting collar so that said resilient member supports said collar ends, said resilient member having a bore;

engaging such in-ground member with said resilient member to force said resilient member against said collar ends to force said collar ends against said mounting collar to provide rigidity to said stabilizer; and driving said plurality of arms into the ground.

15. The method of claim 14 wherein such in-ground member is engaged with said resilient member by inserting such in-ground member into the bore of said resilient member.

16. The method of claim 14 further comprising, before driving said plurality of arms into the ground, excavating a portion of the ground.

17. The method of claim 14 wherein the arms are integral members and the first end comprises a bend of approximately 90 degrees.

* * * * *